United States Patent [19]

Gröger

[11] 4,217,070

[45] Aug. 12, 1980

[54] SYSTEM FOR PLACING ITEMS

[76] Inventor: Erwin Gröger, 32, Starhemberggasse, A-1040 Vienna, Austria

[21] Appl. No.: 790,986

[22] Filed: Apr. 26, 1977

[30] Foreign Application Priority Data

Feb. 8, 1977 [AT] Austria ..... 808/77

[51] Int. Cl.[2] ..... E04H 6/06

[52] U.S. Cl. ..... 414/239; 104/135; 414/676; 414/749

[58] Field of Search ..... 214/16.1 R, 16.1 CC, 214/16.1 CE, 16.1 B, 16.1 CD, 16.1 CF, 16 B, 11 R, 38 B, 38 BB; 180/115–116, 123–124; 198/619; 104/135; 193/35 A, 35 SS, 35 C, 35 MD; 414/234, 236–239, 240, 267, 286, 676, 749

[56] References Cited

U.S. PATENT DOCUMENTS

| | | | |
|---|---|---|---|
| Re. 12,620 | 3/1907 | Slick | 214/38 BB X |
| 3,273,727 | 9/1966 | Rogers et al. | 214/16 B |
| 3,333,714 | 8/1967 | Sermet | 214/16.1 CC |
| 3,447,665 | 6/1969 | Egeland et al. | 193/35 MD X |
| 3,653,485 | 4/1972 | Donlon | 214/16 B X |
| 3,709,381 | 1/1973 | Sullivan et al. | 214/16 B X |
| 3,860,130 | 1/1975 | Frangos | 214/16.1 B |

FOREIGN PATENT DOCUMENTS

| | | | |
|---|---|---|---|
| 689075 | 3/1953 | United Kingdom | 214/16.1 CD |

*Primary Examiner*—Robert G. Sheridan
*Attorney, Agent, or Firm*—Imirie and Smiley

[57] ABSTRACT

A system for placing items, preferably for parking motor vehicles in a garage, comprises shiftable carrying plates, which carry the items and occupy a plurality of respective carrying plate positions arranged thoughout the available area in rows, which are transverse to each other and preferably at right angles to each other and may be disposed in a plurality of stories, if desired. The carrying plates occupy all but at least one of said carrying plate positions. Shifting means are provided for shifting each carrying plate between each carrying plate position and an adjacent one forwardly and rearwardly in the directions of said rows.

4 Claims, 17 Drawing Figures

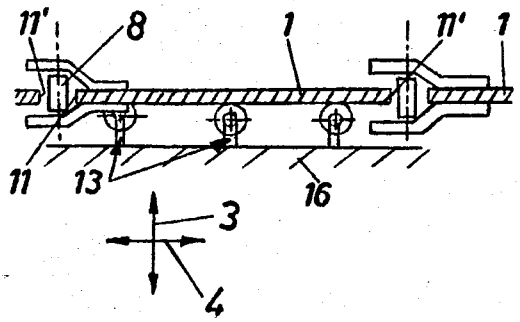
FIG. 2
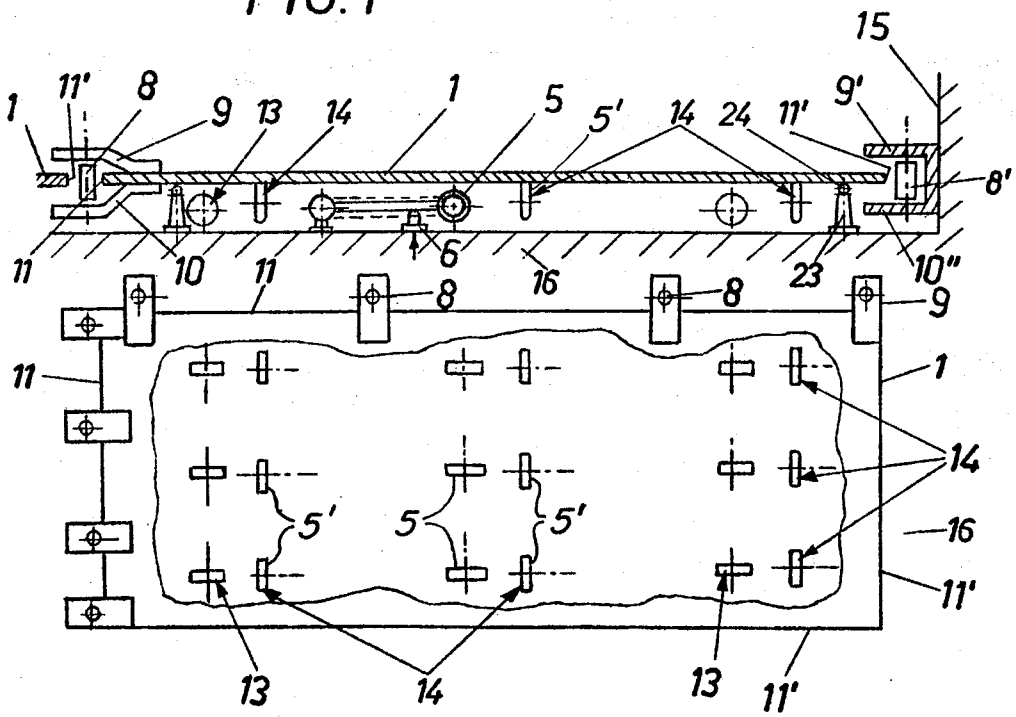
FIG. 1
FIG. 3

SYSTEM FOR PLACING ITEMS

SUMMARY OF THE INVENTION

A system for parking motor vehicles in garages comprises carrying plates for carrying the motor vehicles. The carrying plates occupy the entire parking area of the garage except for at least one free area which has the plan configuration of a carrying plate. With utilization of the free area, the carrying plates are shifted by the shifting means until the desired carrying plate has been moved to the entrance or exit of the garage.

This invention relates to a system for placing items, particularly for parking motor vehicles in a garage. It is known to provide garages with access ways and with parking areas for cars around the access ways. In such garages, the access ways occupy more than 50% of the useful parking area.

It is an object of the invention to enable an optimum utilization of the parking area. This is accomplished in that carrying plates are provided in the area, possibly in a plurality of stories, and in such a number that the carrying plates occupy the entire area except for at least one free carrying plate position. The carrying plates can be shifted forwardly and rearwardly and possibly up and down to and from each carrying place position in the directions of the rows of carrying plates, which directions are preferably at right angles to each other.

The invention will be explained more fully with reference to two illustrative embodiments, which are shown on the drawings and which do not limit the invention.

In the drawings

FIG. 1 is a side elevation, partly in section,

FIG. 2 a front elevation, partly in section, and

FIG. 3 a top plan view, partly in section showing a carrying plate placed in the parking area as well as the shifting means and portions of adjacent carrying plates and wall fixtures.

FIG. 4 consists of diagrammatic top plan views I to XVIII showing a parking area which includes twelve carrying plate positions.

FIG. 5 is a side elevation, partly in section and

FIG. 6 a top plan view showing on a larger scale a detail of the edge portion of the carrying plates.

FIG. 7 is a side elevation and

FIG. 8 a top plan view showing lifting and shifting means.

Figure 5:
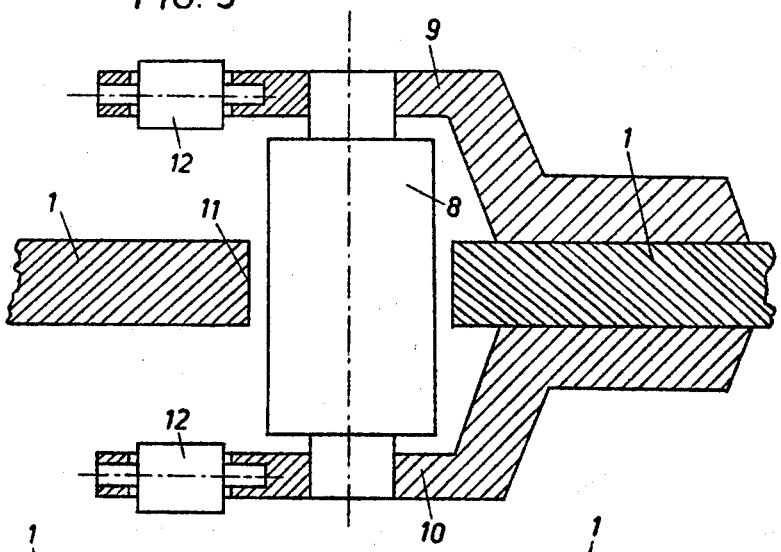
Figure 6:
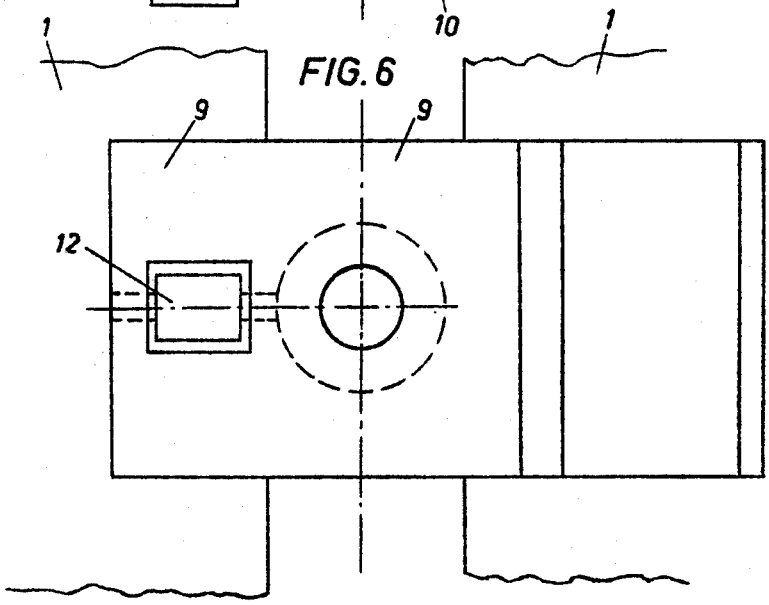
Figure 7:
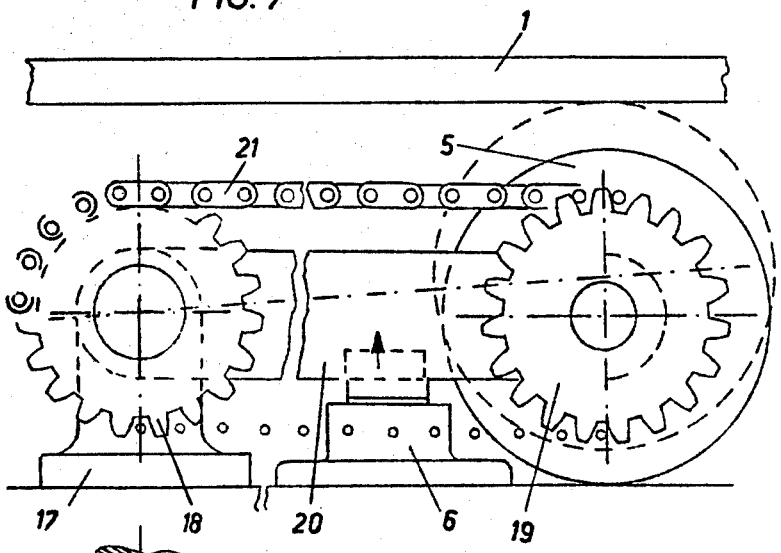
Figure 8:
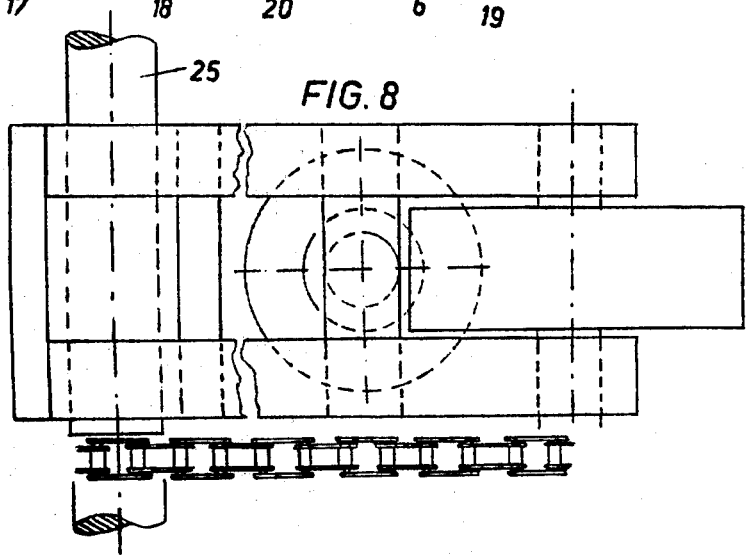
Figure 9:
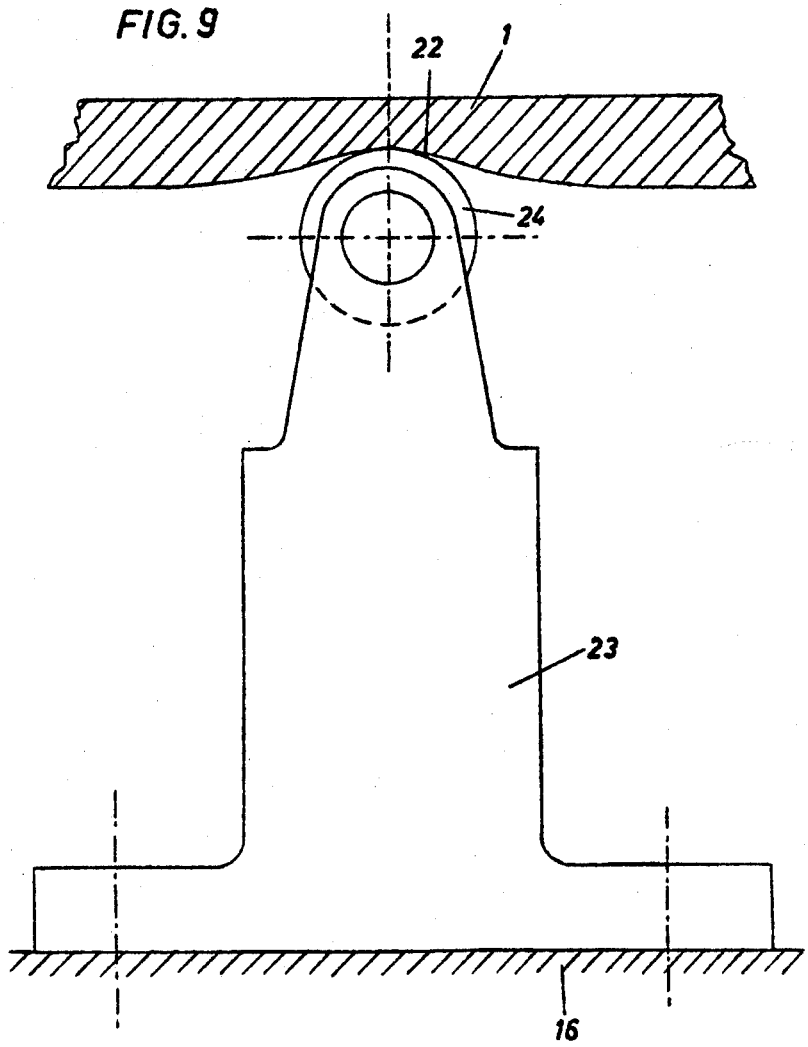
FIG. 9 is a side elevation, partly in section, showing a detail.

As is apparent from FIGS. 1 to 3, systems 13, 14 consisting of rows of wheels are provided on the floor 16 of the parking room. Each system is associated with a carrying plate position and comprises a plurality of rows of wheels 5 and 5' arranged one behind the other, in the present embodiment three rows of three wheels each. By means of a motor, the wheels of each system can be simultaneously rotated synchronously in the same direction in such a manner that the wheels 5' of system 14 can shift a carrying plate 1 forwardly of backwardly in the direction of the arrow 3 and the wheels 5 of system 13 can shift a carrying plate 1 forwardly or backwardly in the direction of arrow 4. By means of a lifting ram 6, the wheels 5 or 5' of each system can be jointly lifted to raise a carrying plate 1 so that the latter will be moved horizontally when the wheels are rotated. For the sake of simplicity, the lifting ram 6 is shown in FIG. 1 in association with the intermediate group of the wheels 5 by which the carrying plate 1 can be shifted in the direction of the double-headed arrow 4. As is particularly apparent from FIGS. 3, 5, and 6, each carrying plate carries rollers 8 at two edges 11, which are at right angles to each other. The remaining two edges 11' of each carrying plate 1 are also at right angles to each other and are free from rollers and projections. The rollers 8 of each carrying plate 1 can roll on adjacent carrying plates 1 on adjacent edges 11 thereof which are free from rollers and projections. On those sides which are provided with the rollers 8, each carrying plate 1 is also provided with upwardly and downwardly offset projections 9 and 10, which respectively extend above and below adjacent carrying plates 1 at those edges 11 thereof which are free from rollers and projections. To facilitate the shifting of the carrying plates 1, the projections 9, 10 carry rollers 12, which are omitted for the sake of simplicity in FIGS. 1 to 3. On two sides which face those edges 11' of the carrying plates 1 which are free from rollers and projections, the boundary wall 15 is also provided with rollers 8' and projections 9', 10' and the projections 9', 10' are provided with rollers which correspond to the rollers 12 of the carrying plates 1 and which are not shown in FIG. 1 for the sake of clearness. The rollers 8' and projections 9' and 10' are disposed above and below those edges 11' of the carrying plates 1 which are free from projections. The remaining walls of the room extend also at right angles to each other and are provided with projections, which correspond to the carrying plates and are engaged by projections 9, 10 of the adjacent carrying plates 1. When the area is fully occupied by carrying plates 1, the edge structures described hereinbefore ensure that the carrying plates will guide each other and will be retained against tilting and that the carrying plates 1 can be shifted much more easily. FIGS. 7 and 8 shows the details of the lifting mechanism comprising the lifting ram 6 and of the means for shifting the carrying plates 1. Each wheel 5 (or 5') is rotatably mounted on a lever arm 20, which is pivoted in a bearing bracket 17. The lever arm 20 bears on the lifting ram 6, which is hydraulically operable. As the lifting ram 6 is being lifted, the lever arm 20 lifts the wheel 5 and with it the carrying plate 1. Only the wheels 5 5' of one of the two systems 13 or 14, respectively are lifted at one time. Each wheel 5 (or 5') is adapted to be driven by means of a drive axle 25, chain sprocket 18, chain 21, and chain sprocket 19. Whereas the carrying plate 1 is continuous, it is shown partly cut away in FIG. 3 so that the wheel systems 13, 14 under the carrying plate are visible. As is apparent from FIG. 9, each carrying plate 1 is provided on the rear with a plurality of detent grooves 22, which are not shown in FIG. 2 for the sake of simplicity. Detent brackets 23 are fixed to the floor 16 and are provided with rollers 24, which enter the grooves 22 of a carrying plate 1 as it is lowered. Unless it has been shifted exactly to the proper position, a carrying plate 1 which has been lowered will roll on the rollers 24 or balls until the rollers engage the apex of the groove 22 so that the carrying plate 1 is located in an initial position for a shifting in a second direction.

Figure 4:
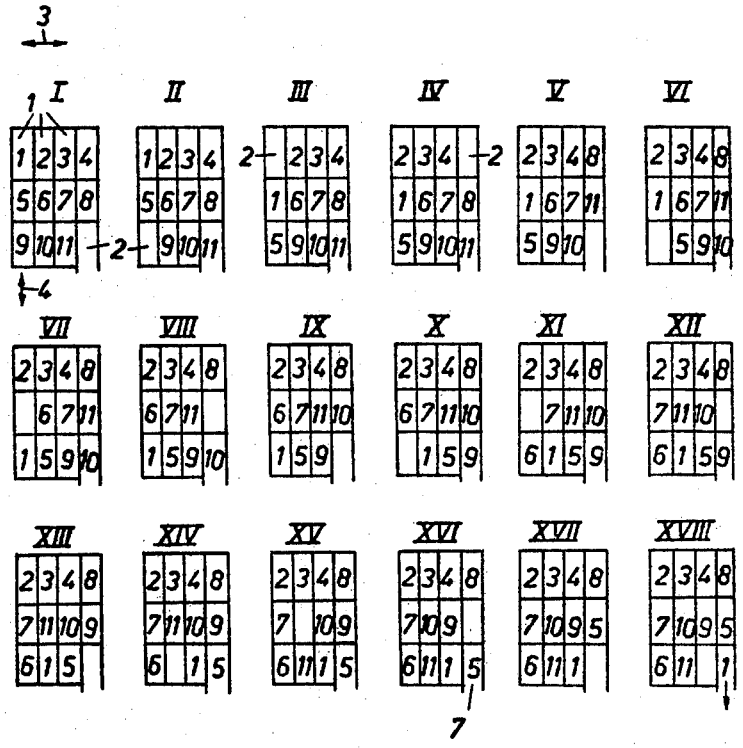

FIG. 4 shows eighteen different carrying plate arrangements I—XVIII in an area which has twelve carrying plate positions. In arrangement I, there is a free carrying plate position 2 at the loading-unloading station 7 and the diagrammatically indicated carrying plates No. 1 to No. 11 are arranged in rows which are at right angles to each other. The shifting of carrying plate No. 1 toward the loading-unloading station 7 is shown by way of example. For this purpose, the carrying plates No. 9, No. 10, and No. 11 are moved to the right by one carrying plate position so that the empty carrying plate position is aligned with the row which contains carrying plate No. 1. To that end, the wheel systems for shifting the carrying plates No. 9, No. 10, and No. 11 in the direction of arrow 3 are lifted and are then rotated in the proper sense. When the carrying plates No. 9, No. 10, and No. 11 have been lowered, the wheel systems for shifting the carrying plates No. 1 and No. 5 in the direction of arrow 4 are lifted and rotated to shift said carrying plates forwardly. The other carrying plates are analogously lifted, shifted, and lowered in such a manner that the free carrying plate position 2 is indirectly shifted or successive free carrying plate positions 2 are provided to which the carrying plate No. 1 can be shifted in successive steps. It is apparent from FIG. 4 that the carrying plate No. 1 can thus be shifted to the loading-unloading station in seventeen individual steps and that each carrying plate which has been placed at a given position can be shifted in a few steps to the loading-unloading station. A predetermined program may be stored, which may be used for an automatic control of a sequence of lifting and shifting steps in such a manner that a carrying plate from any desired carrying plate position is shifted to the loading-unloading station. Besides, an address-detecting system may be provided for a quick detection of the carrying plate position which is occupied by a desired carrying plate. In that case each carrying plate can be loaded and can then be moved in the area by desired shifting operations. When the location of the carrying plate is detected by the address-detecting system said carrying plate can be automatically shifted to the loading-unloading station 7 and can be unloaded and reloaded there. It will be understood that the number of rows and of loading-unloading stations in the system may be larger or smaller than in the embodiment shown by way of example and that the invention is not restricted to a two-dimensional system but may also be applied to three-dimensional system, provided that the carrying plates can be shifted also vertically, e.g., by means of suitable elevators. In that case it will be sufficient to provide for a vertical shifting of only part of the plates. For instance, an elevator which serves a plurality of stories may be provided in a parking garage, in which the loading-unloading stations are vertically superimposed.

Figure 10:
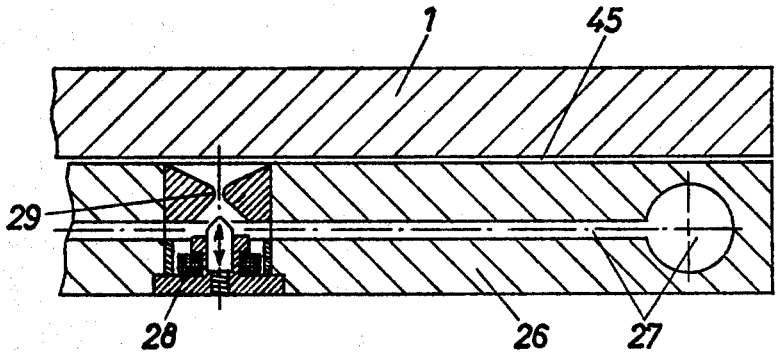
FIGS. 10 to 13 show pneumatic lifting means for forming a cushion of air.
Figure 11:
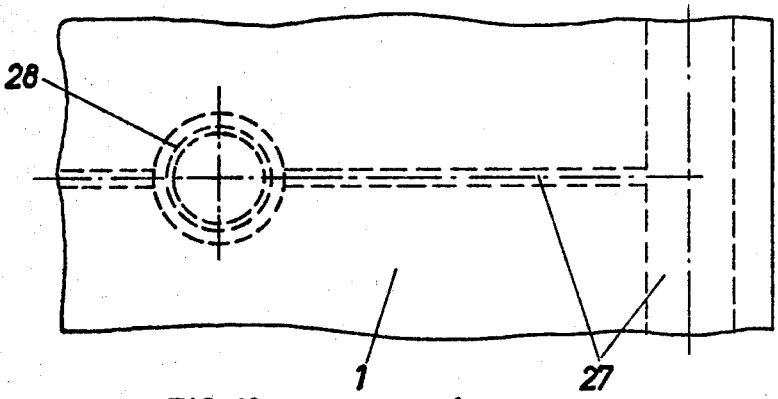
Figure 12:
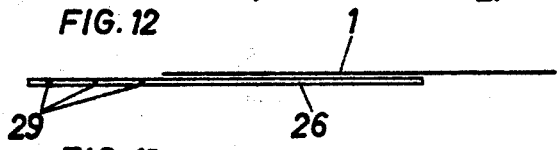
Figure 13:
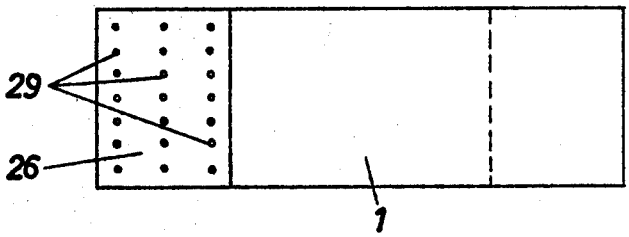
Figure 14:
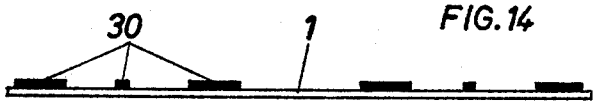
FIGS. 14 to 17 show electromagnetic shifting means.
Figure 15:
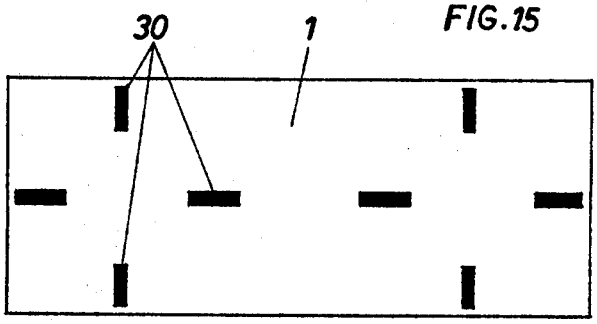
Figure 16:
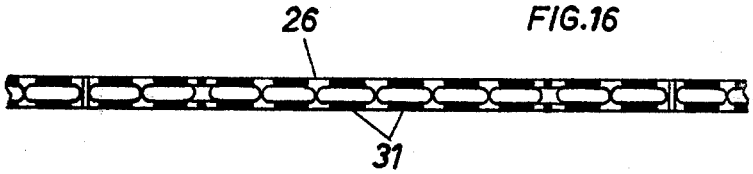
Figure 17:
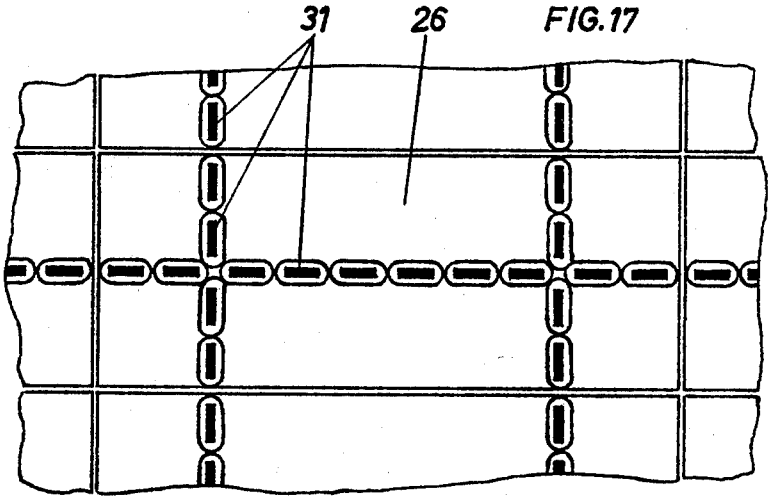

Another embodiment of the invention is shown in FIGS. 10 to 17. FIGS. 10 and 11 show a pneumatic lifting mechanism, which comprises a floor plate, on which a carrying plate is carried by a thin cushion of air. FIGS. 12 and 13 show the arrangement of the air discharge nozzles in the baseplate and a partly shifted carrying plate. FIGS. 14 and 15 show a carrying plate provided with low-reluctance slugs, and FIGS. 16 and 17 show the associated floor plate provided with solenoids, which together with the low-reluctance slugs constitute electromagnetic shifting means. FIG. 10 is a transverse sectional view showing a detail of a carrying plate 1, which hovers on a film of air 45 over the floor plate 26. In that condition, any movement of the carrying plate in a horizontal or slightly inclined directions will be opposed by only slight friction. Compressed-air conduits 27 incorporated in floor plate 26 serve to supply compressed air to a solenoid valve 28. When the latter is actuated, compressed air is discharged through a nozzle 29 to form a carrying film of air 45 between the floor plate 26 and the overlying carrying plate 1. In certain cases, the arrangement may be simplified in that one and the same solenoid valve 28 is used to supply compressed air to a plurality of nozzles 29 and there is no need for a plurality of solenoid valves 28 when air is to be charged through all nozzles 29 simultaneously. The solenoid valves 28 are preferably electronically controlled in such a manner that air is discharged only through those nozzles 29 which are disposed under a carrying plate 1 which is to be shifted.

FIG. 11 is a top plan view showing the compressed-air conduit 27 and the solenoid valve 28.

FIGS. 12 and 13 are, respectively, an elevation and a top plan view showing a complete floor plate 26 with the nozzles 29 and an overlying carrying plate 1, which has partly been shifted.

FIGS. 14 and 15 are, respectively, an elevation and a top plan view showing a complete carrying plate 1, which incorporates spaced apart low-reluctance slugs 30, which extend in certain directions.

FIGS. 16 and 17 are, respectively, an elevation and top plan view showing a complete floor plate 26, which incorporates spaced apart solenoids 31, which extend in certain directions.

The low-reluctance slugs 30 shown in FIGS. 14 and 15 may consist of iron and cooperate with the solenoids 31 shown in FIGS. 16 and 17 to shift the carrying plate 1 relative to the baseplate 26 in longitudinal and transverse directions. The low-reluctance slugs 30 follow a travelling magnetic field, which is established by the solenoids 31, so that the carrying plate 1 can easily be shifted to the desired end position. The structure and arrangement of the low-reluctance slugs 30 and the solenoids 31 may differ from the embodiment shown in FIGS. 14, 15 and FIGS. 16, 17.

When it is desired, e.g., to shift a carrying plate 1 in a selected direction, the carrying plate 1 is caused to hover on the film of air 45 and the associated solenoids 31 disposed under a certain set of low-reluctance slugs 30 are then energized to establish a magnetic field. This magnetic field is then uniformly decreased and the next solenoids 31 in the desired direction of movement are energized to the same degree. A travelling magnetic field results, which causes the overlying low-reluctance slugs 30 to travel along with it so that the carrying plate 1 is uniformly shifted to its destination. The timed energization of the solenoids 31 is preferably electronically controlled.

Alternatively, mechanical means may be used to shift the hovering carrying plate 1 in a horizontal direction. Such mechanical means may comprise gears in mesh with racks, or friction wheels, horizontal rams and the like. By means of a suitable chamber system, even the outflowing air may be used to impart a horizontal movement to the carrying plate 1. Any technical shifting means may be omitted if the user contemplates the shifting of such carrying plate 1 by hand because the film of air 45 minimizes the friction between the carrying plate 1 and the floor plate 26.

It will be understood that the embodiment shown in FIGS. 1 to 3 may be modified in various ways within the scope of the invention. For instance, the carrying plates may be shifted by means of chains or on slideways or by other shifting means rather than by means of wheels. The lifting rams may be operated hydraulically or electromagnetically or by a power screw or other means or may be replaced by lifting linkages or other lifting means. The plates may constitute platforms and may be provided with means for fixing cars or other items. The underside of the plates or platforms is substantially plane, except for the detent grooves for locating the plate. Fixing and retaining means may be provided on the top. The shifting wheel can suitably idle so that the plates can roll to the proper position when the drive means have been deenergized. The projections and wheels must be so spaced and arranged that they do not obstruct each other.

What is claimed is:

1. A system for placing items, such as motor vehicles in garages, comprising a floor having an available area thereon that contains a plurality of carrying plate positions arranged in mutually transverse rows;

a plurality of shiftable carrying plates for supporting the items in corresponding ones of said plurality of carrying plate positions, the number of carrying plates being selected so as to leave at least one carrying plate position unoccupied, each carrying plate having at least two sides which can respectively engage a corresponding side of other carrying plates when adjacent thereto;

engagement means mounted on two of said carrying plate sides for lateral sliding and guiding engagement with corresponding sides of carrying plates without said engagement means when adjacent thereto;

nozzles incorporated in said floor for discharging compressed air through said floor;

solenoid valves connected to said nozzles such that when a solenoid valve is actuated, compressed air is selectively supplied to at least one corresponding nozzle so that a plate-carrying film of air can be selectively formed between said floor and a selected one of said plates; and electromagnetic means for selectively shifting each carrying plate from one carrying plate position to an adjacent one comprising a plurality of aligned, spaced apart low-reluctance slugs carried by said carrying plates, and spaced apart solenoids mounted on said floor in magnetic cooperation with said slugs such that when said solenoids are selectively energized, a travelling magnetic field is produced that attracts the slugs of a plate proximity located to the energized solenoid and shifts said plate in the direction of said travelling magnetic field.

2. A system as set forth in claim 1 characterized in that each carrying plate has two sides which are at right angles to each other and provided with upwardly and downwardly offset projections and rollers rotatably mounted in corresponding projections, and two sides of which are free from projections and said projections of each of said carrying plates extend respectively above and below adjacent carrying plates on sides thereof which are free from projections.

3. A system as set forth in claim 2 wherein a first roller is rotatably mounted about a vertical axis between said upwardly and downwardly offset projections.

4. A system for placing items, such as motor vehicles in garages, comprising a floor;

nozzles for discharging compressed air incorporated in said floor;

solenoid valves connected to said nozzles;

a plurality of shiftable carrying plates for supporting the items in a plurality of carrying plate positions arranged in mutually transverse rows throughout the available area of said floor, the number of carrying plates being selected so as to leave at least one carrying plate position unoccupied, each carrying plate having two sides which are at right angles to each other and provided with upwardly and downwardly offset projections and a first roller, a second roller, and a third roller rotatably mounted in corresponding projections, and two sides of which are free from projections, said projections of each of said carrying plates extending respectively above and below adjacent carrying plates on sides thereof which are free from projections, said first roller being rotatably mounted about a verticle axis between said upwardly and downwardly offset projections and said second and said third rollers being rotatably mounted about a horizontal axis in said upwardly and downwardly offset projections, respectively; and electromagnetic means for shifting each carrying plate from one carrying plate position to an adjacent one comprising low-reluctance slugs carried by said carrying plates, and spaced apart solenoids mounted on said floor for cooperating with said slugs.

* * * * *